United States Patent [19]

Westervelt

[11] 4,403,404

[45] Sep. 13, 1983

[54] METHOD OF MAKING A CELLULOSE-FREE TRANSFORMER COILS

[75] Inventor: Dean C. Westervelt, Bullskin Township, Westmoreland County, Pa.

[73] Assignee: Westinghouse Electric Corp., Pittsburgh, Pa.

[21] Appl. No.: 308,314

[22] Filed: Oct. 2, 1981

[51] Int. Cl.[3] ..... H01F 41/06

[52] U.S. Cl. ..... 29/605; 336/205; 336/206; 427/116; 427/117

[58] Field of Search ..... 29/605; 336/205, 206; 427/116, 117, 118, 120, 420

[56] References Cited

U.S. PATENT DOCUMENTS

| | | | |
|---|---|---|---|
| 3,963,882 | 6/1976 | Lewis | 29/605 X |
| 4,095,557 | 6/1978 | Croop et al. | 29/605 X |
| 4,174,510 | 11/1979 | Smith et al. | 29/605 X |

*Primary Examiner*—Carl E. Hall

*Attorney, Agent, or Firm*—L. P. Johns

[57] ABSTRACT

A coil structure for cellulose-free transformer coils characterized by a plurality of helically wound layers disposed in a zig-zag pattern with wedge-shaped resinous insulators between each layer.

5 Claims, 14 Drawing Figures

FIG. 1.
PRIOR ART
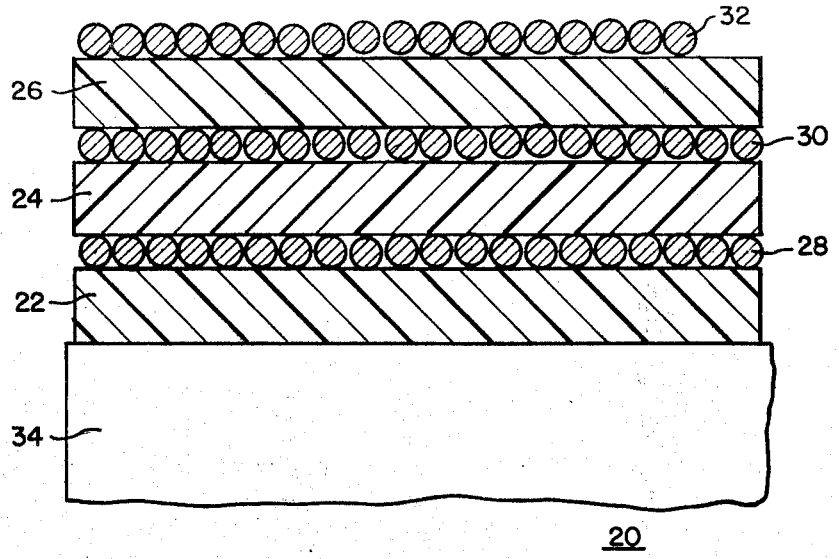
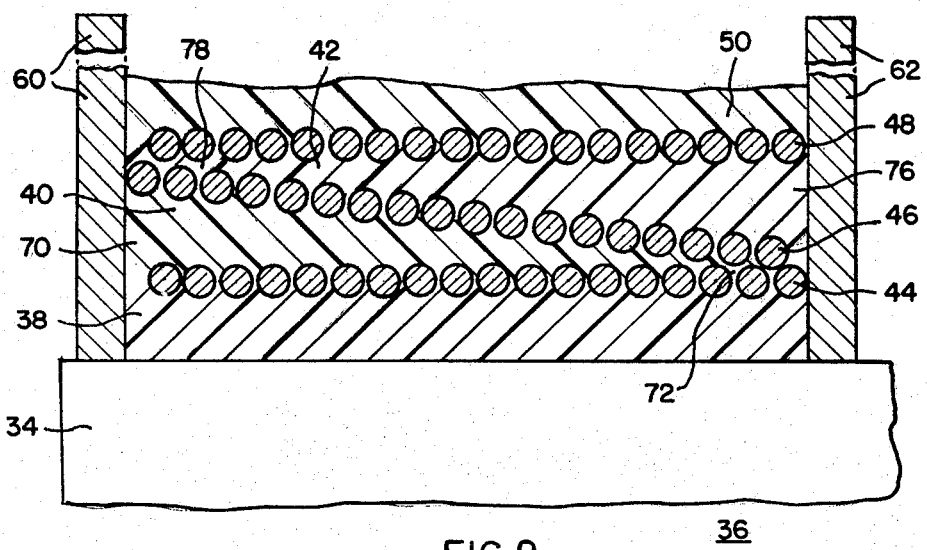
FIG. 2.

METHOD OF MAKING A CELLULOSE-FREE TRANSFORMER COILS

BACKGROUND OF THE INVENTION

1. Field of the Invention

This invention relates to a coil structure for a transformer and, more particularly, it pertains to a cellulose-free transformer coil construction.

2. Description of the Prior Art

Conventionally wound transformer coils using round and rectangular enameled wire and designed with uniform layers of wire and paper spaced alternately. The winding sequence is that of applying turns of wire side-by-side helically around the central axis of the coil until a layer is completed. A layer of paper having the full width of the coil is then wrapped over the wire turns to provide insulation. With this insulation in place, the winding is continued with another layer of wire traversing in the opposite direction across the coil width. The dielectric stress from layer to layer is thus very low at one end of the coil and relatively high at the other end. Consequently, the coil size is influenced by the thickness of paper that must be applied to withstand the highest dielectric stress.

SUMMARY OF THE INVENTION

In accordance with this invention it has been found that a more satisfactory transformer coil may be provided which is devoid of cellulose, comprising a tubular coil structure having a plurality of turns of a helically wound conductor forming a first layer, a wedge shaped resinous insulator coextensive with and around the first layer and having a thin edge at one end of the first layer and a thick edge at the other end thereof, a second layer on the side of the first insulator opposite the first layer and comprising a plurality of additional helical turns of the wound conductor, a wedge shaped second resinous insulator coextensive with and around the second layer and having thin and thick edges oppositely disposed of the first insulator, and a third layer on the side of the second insulator opposite the first layer and forming with the first and second coils a zig-zag coil configuration.

The invention also comprises a method for making a non-cellulose insulated transformer coil comprising the steps of providing a winding mandrel for repeated rotation past a resin applicator and a resin curing station, applying a layer of resinous material onto the mandrel upon a single rotation of the mandrel, curing the layer of resinous material in place as the mandrel is rotated adjacent to the curing station, coiling a first number of turns of a preinsulated conductor helically onto and over the tubular hub, applying a first tapered resinous insulator coextensive with and around the first turns of the preinsulated conductors and having a thin edge at one end of the first layer and a thick edge at the other end thereof, curing the first tapered resinous insulator, coiling a second number of turns of the preinsulated conductor helically onto and over the first tapered resinous insulator on the side opposite the first number of turns, applying a second tapered resinous insulator coextensive with and around the second turns of preinsulated conductor and having thin and thick edges oppositely disposed to those of the first tapered insulator, curing the second tapered resinous insulator, and coiling a third number of turns of the preinsulated conductor helically onto and over the second tapered resinous insulator on the side opposite the second number of turns.

The advantage of the device of this invention is that the coil structure, comprising a resinous insulator rather than a cellulose insulator, is more durable than coils embodying cellulosic insulators.

This application is related to commonly assigned applications Ser. No. 308,315, filed Oct. 2, 1981 and Ser. No. 264,151, filed May 15, 1981.

BRIEF DESCRIPTION OF THE DRAWINGS

FIG. 1 is a cross sectional view through a coil structure of prior art construction;

FIG. 2 is a cross sectional view of a coil structure in accordance with this invention;

DESCRIPTION OF THE PREFERRED EMBODIMENTS

Figure 3:
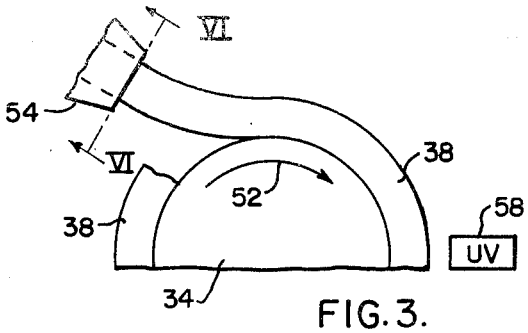
FIGS. 3, 4, 5 are fragmentary end views showing successive stages of the application of cylindrical insulators during assembly of a coil.

In FIG. 1 a partial transformer coil of prior art construction is generally indicated at 20. It comprises concentrically disposed tubes 22, 24, 26 for holding layers of conductor windings 28, 30, 32 in spaced relationship with respect to each other. The tubes 22, 24, 26 are composed of cellulose, such as cardboard, and formed by winding the inner tube 22 onto a rotated mandrel 34. The layer 28 is wound from the left to the right end (FIG. 1). After the cellulosic tube 24 is applied, the winding continues with the same conductor to form the layer 30 from the right to the left. The cellulosic tube 26 is then applied and the winding continues from the left to the right end. Thus, the several layers 28, 30, 32 are provided in substantially concentric patterns with the same enameled conductor being wound continuously for all three layers. It is understood that in the foregoing including the three layers is merely exemplary and that more than three layers of conductors are normally included in a transformer coil.

In accordance with this invention it has been found that a coil structure generally indicated at 36 (FIG. 2) may be provided which comprises insulators 38, 40, 42 for mounting layers of conductor windings 44, 46, 48 in place. The insulators 38, 40, 42 consist of an electrically dielectric material, such as an epoxy resin, that is thermosetting. The insulators 40, 42 are wedge-shaped bodies so that the configuration of the assembled layers 44, 46, 48 has a reversing or zig-zag pattern. Moreover, though only three layers 44, 46, 48 are shown, more conductor layers and wedge-shaped insulators may be provided as required. Finally, the outer layer of conductor winding is covered with a layer 50 of resin similar to that of the insulator 38.

Figure 6:
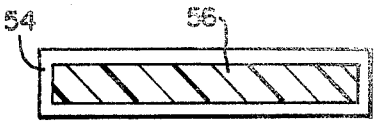
FIGS. 6, 7, 8 are views taken on the lines VI, VII, VIII of FIGS. 3, 4, 5, respectively.
Figure 4:
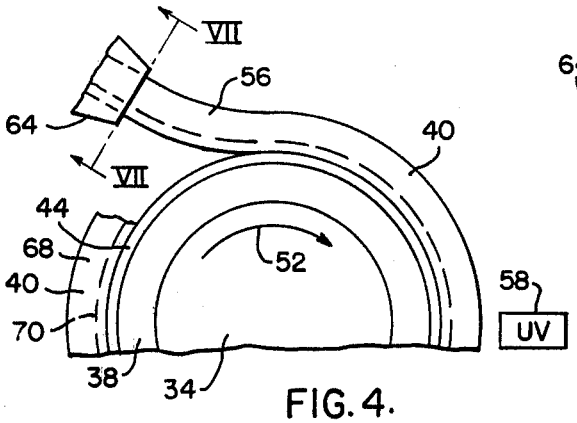
Figure 5:
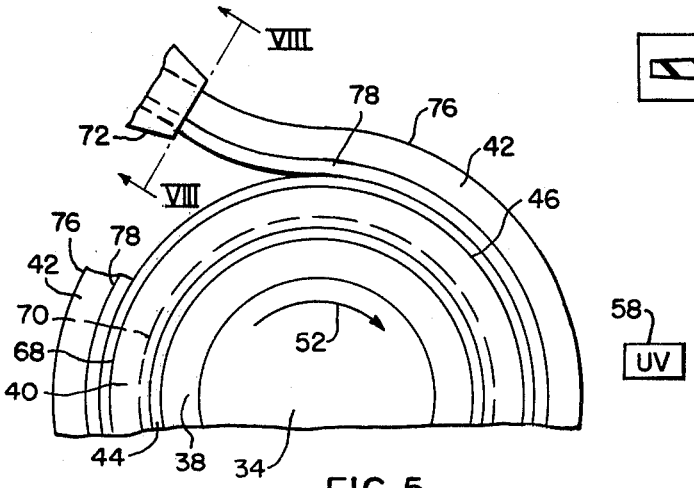

The method by which the coil structure 36 is made is shown in FIGS. 3, 4, 5. The insulator 38 is applied to the outer surface of the mandrel 34 which is rotated in the direction of the arrow 52. The insulator 38 preferably consists of a cross linkable resin that is applied from a nozzle 54, having a rectangular cross section (FIG. 6), from which a dielectric material or resin 56 issues onto the surface of the mandrel 34 forming the insulator 38 as shown. The thickness of the resin 56 is normally sufficient to provide the insulator 38 having the required thickness with one complete turn of the mandrel, whereupon the resin 56 is severed at the end of the nozzle so that abutting ends of the insulator 38 are in end-to-end abutment. The resin 56 has a viscosity of from 20,000 to 80,000 centipoise with a preferred viscosity of about 63,000 centipoise. With that viscosity the insulator 38 is cured or jelled by radiation, such as by an ultra-violet radiator 58 located at a spaced position from the nozzle 54. To facilitate assembly of the coiled structure 36 a pair of spaced collars 60, 62 (FIG. 2) are provided on the mandrel 34. Thus the several parts 38–50 are applied between the collars 60, 62.

Figure 7:
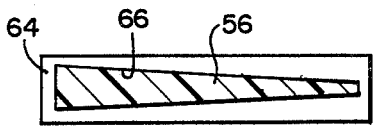
Figure 9:
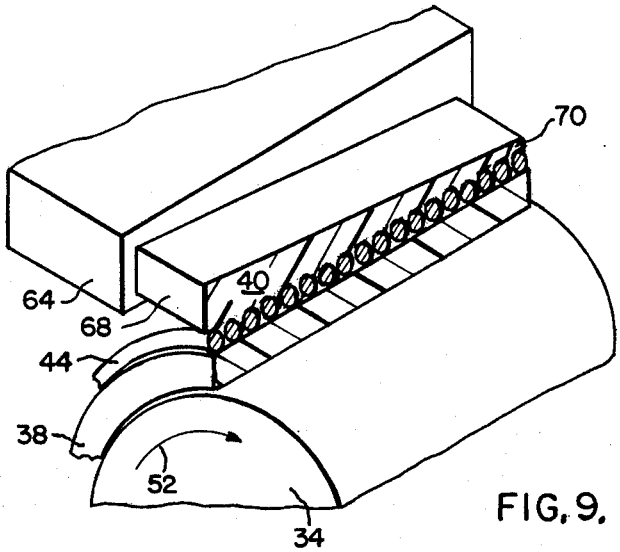
FIG. 9 is an isometric view showing the application of a tapered insulator onto a layer of turns of a conductor during assembly of a coil.

The layer 44 of enameled conductor is applied from left to right (FIG. 2) onto the insulator 38 between the collars 60, 62. After the layer 44 of conductor is applied (FIGS. 2, 4), the insulator 40 is applied in a manner similar to that of the insulator 38. More particularly a nozzle 64 (FIGS. 4, 7) having a triangular or trapezoidal opening 66 is brought into position (FIG. 4) for the application of dielectric material 56 to by applied on and over the layer 44 of conductor. To provide for the necessary resin thickness between the left ends of the layers 44, 46 the insulator 40 has a tapered, wedge-shaped configuration provided by the triangular or tapezoidal opening 66 from which the dielectric material 56 is extruded with a thick edge 68 on the left and a thin edge 70 on the right. As shown in the isometric view of FIG. 9 the manner in which the dielectric material 56 is extruded from the nozzle 64 onto the layer 44 of the wound conductor is shown with the insulator 40 being coextensive with the layer. The thick edge 68 is disposed on the left and the thin edge 70 is disposed on the right of the layer. Thus, the insulator 40 is applied upon a single turn of the mandrel 34 in a manner similar to the insulator 38 with the insulator 40 being solidified or cured as it rotates past the radiator 56.

Figure 8:
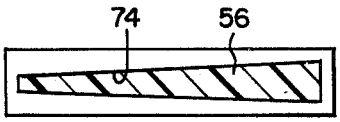

With continued rotation of the mandrel 34 FIG. 5 the layer 46 of the conductor is applied helically onto the outer surface of the insulator 40 from the right to the left edge thereof. Thereafter a nozzle 72 for applying the insulator 42 is brought in position. The nozzle 72 (FIG. 8) comprises a triangular or trapezoidal opening 74 through which the dielectric material 56 is extruded to form the insulator 42 on the outer surface of the turns of the layer 46. Again, to provide the necessary resin thickness between the right ends of the layers 46, 48 (FIG. 2) to protect the area of maximum dielectric stress a thick edge 76 and a thin edge 78 are provided at the right and left ends, respectively, of the insulator 40. Thus, the thin and thick edges of the insulators 40, 42 are oppositely disposed. Thereafter the layer 48 of conductor turns is applied on the outer surface of the insulator 42.

It is understood that additional layers of conductor winding and insulators may be applied as required, but for the purpose of illustration it is assumed that the layer 48 is the outer most layer of the conductor. The layer 50 of insulator is then applied in a manner similar to the application of the insulator 38. Each time an insulator 38, 40, 42, 50 is applied it is solidified or jelled as a mandrel 34 rotates the insulator past the ultra-violet radiator 58.

Figure 10:
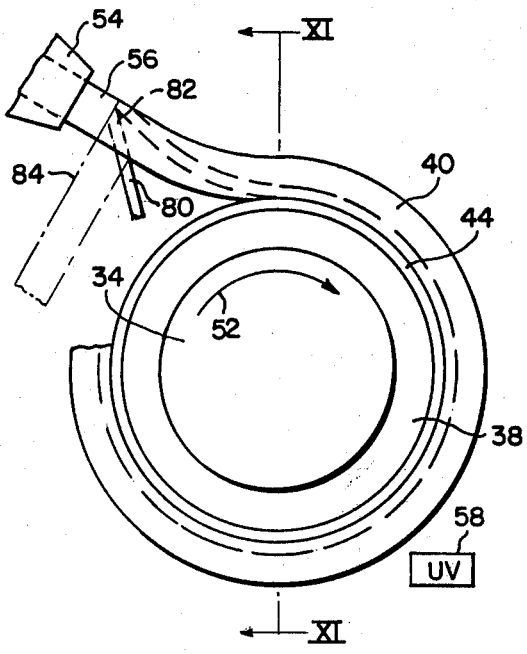
FIG. 10 is a schematic view of another embodiment of this invention.
Figure 11:
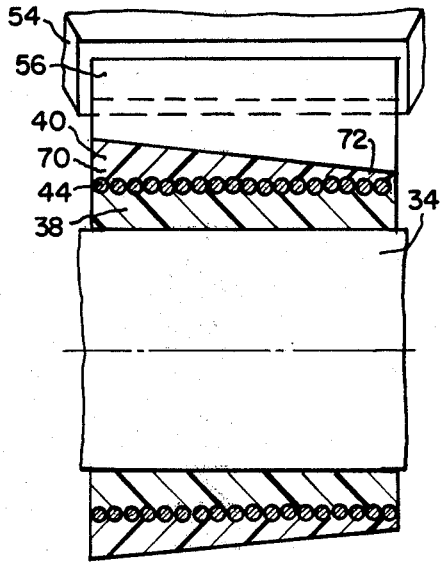
FIG. 11 is a vertical sectional view taken on the line XI—XI of FIG. 10.

Another method for complying the insulator 40 is shown in FIGS. 10, 11 in which similar numerals refer to similar parts throughout the drawings. The nozzle 54 having a rectangular cross section through which dielectric material 56 is extruded is provided with a scraper or knife blade 80 for cutting the rectangular cross section of the material 56 into a triangular or trapezoid configuration by providing the blade 80 with a beveled cutting edge 82 for removing a cutaway portion 84.

Figure 12:
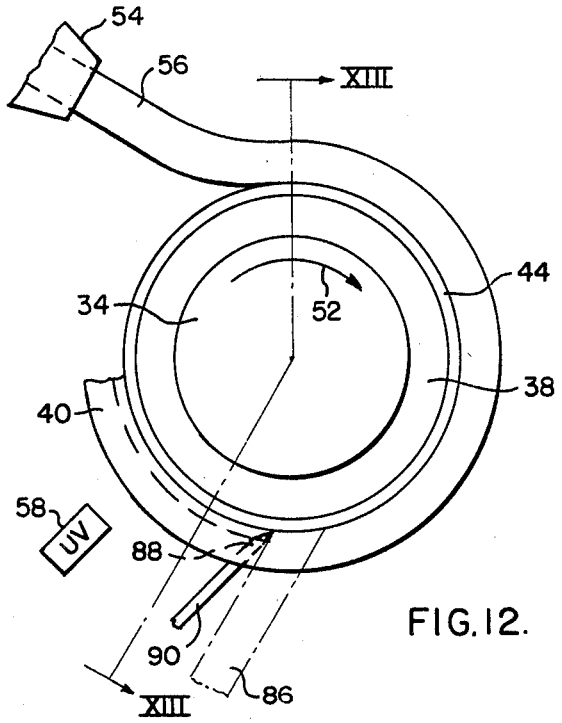
FIG. 12 is a schematic view of another embodiment of the invention.
Figure 13:
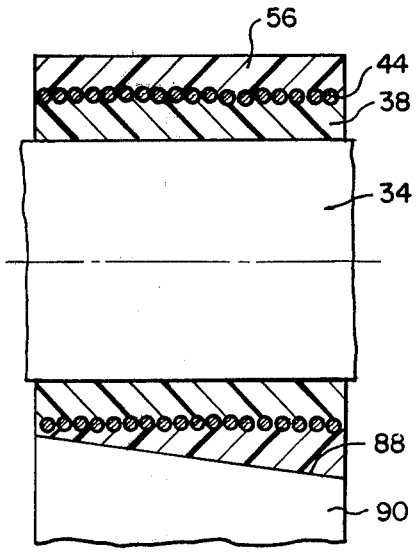
FIG. 13 is a vertical sectional view taken on the line XIII—XIII of FIG. 12.
Figure 14:
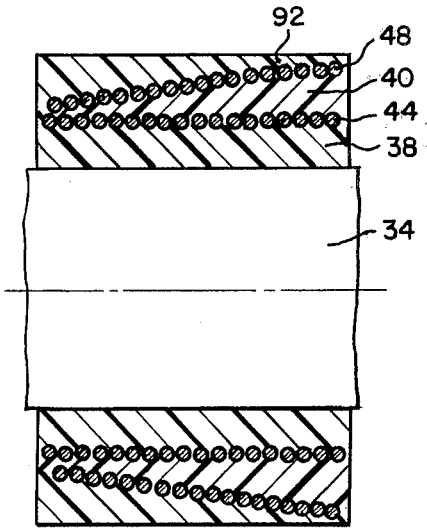
FIG. 14 is a vertical sectional view showing another embodiment of the invention.

Still another embodiment is shown in FIGS. 12, 13, 14 in which similar numerals refer to similar parts throughout the several drawings. As in the previous embodiment of FIG. 10 dielectric material 56 issues from a nozzle 54 onto the layer 44 of the conductor. As the mandrel 34 rotates a cutaway portion 86 of dielectric material is removed by a beveled edge 88 of a scraper or knife blade 90. Continued rotation of the mandrel 34 moves the remaining portion of the insulator 40 past the ultra-violet radiator 58.

Additional layers and insulators (FIG. 14), such as the layer 48 and insulator 92, may be added as required to complete a transformer coil.

In conclusion a method is disclosed for producing a tapered insulation between layers of a coil of an electrical conductor which insulation is a curable resin that is metered onto the layers of the conductor by an angled wiper blade to remove excess resin, following which the resinous insulation is cured by an ultra-violet radiator.

What is claimed is:

1. A method for making a non-cellulose insulated transformer coil comprising the steps of:

(a) providing a winding mandrel for repeated rotation past a resin applicator and a resin curing station;

(b) applying a layer of resinous material onto the mandrel upon a single rotation of the mandrel, forming a tubular hub;

(c) curing the layer of resinous material in place as the mandrel is rotated adjacent to the curing station;

(d) coiling a first number of turns of a conductor helically onto and over the tubular hub;

(e) applying a first tapered resinous insulator coextensive with and around the first turns of conductors and having a thin edge at one end of the first layer and a thick edge at the other end thereof;

(f) curing the first tapered resinous insulator;

(g) coiling a second number of turns of the conductor helically onto and over the first tapered resinous insulator on the side opposite the first number of turns;

(h) applying a second tapered resinous insulator coextensive with and around the second turns of conductor, and having thin and thick edges oppositely disposed to those of the first tapered insulator;

(i) curing the second tapered resinous insulator;

(j) coiling a third number of turns of the conductor helically onto and over the second tapered resinous insulator on the side opposite the second number of turns; and (k) the layers of resinous material being each applied at steps (b), (e), and (h) during one revolution of the mandrel.

2. The method of claim 1 in which the outermost coil of conductors is covered with a coating of cured resin.

3. The method of claim 1 in which the steps (d) through (j) are repeated.

4. The method of claim 1 in which the viscosity of the resinous material from 20,000 to 80,000 centipoise.

5. The method of claim 1 in which the resinous material is an epoxy resin.

* * * * *